US009875728B1

(12) United States Patent
Pallay

(10) Patent No.: US 9,875,728 B1
(45) Date of Patent: Jan. 23, 2018

(54) MUSICAL KEY-CHANGING APPARATUS FOR STRINGED INSTRUMENTS

(71) Applicant: John Paul Pallay, Ontario, OH (US)

(72) Inventor: John Paul Pallay, Ontario, OH (US)

( * ) Notice: Subject to any disclaimer, the term of this patent is extended or adjusted under 35 U.S.C. 154(b) by 0 days.

(21) Appl. No.: 14/999,278

(22) Filed: Apr. 19, 2016

Related U.S. Application Data

(60) Provisional application No. 62/178,728, filed on Apr. 20, 2015.

(51) Int. Cl.
*G10D 3/08* (2006.01)

(52) U.S. Cl.
CPC ..... *G10D 3/085* (2013.01)

(58) Field of Classification Search
CPC ..... G10D 13/02; G10D 13/08; G10D 13/021; G10D 13/023; G10D 13/028; G10D 13/00; G10D 13/026; G10K 3/00; G10K 1/10; G10G 1/00
See application file for complete search history.

(56) References Cited

U.S. PATENT DOCUMENTS

| | | | | |
|---|---|---|---|---|
| 2,043,121 | A | 6/1936 | Quemore | |
| 2,486,549 | A | 11/1949 | Bonkowski et al. | |
| 3,499,357 | A * | 3/1970 | Peterson, Jr. ..... | G10D 3/085 84/285 |
| 3,780,612 | A | 12/1973 | Robinson | |
| 4,020,730 | A | 5/1977 | Hill | |
| 4,481,855 | A | 11/1984 | Bozung | |
| 5,033,349 | A | 7/1991 | Nechville | |
| 7,534,950 | B2 | 5/2009 | Lyles | |
| 8,188,352 | B2 | 5/2012 | Bryant | |

* cited by examiner

*Primary Examiner* — Kimberly Lockett

(57) ABSTRACT

This invention, a key-changing apparatus for stringed musical instruments, automatically sets all the strings to the necessary flats and sharps for any key signature selected. This allows musicians, particularly novices, to play musical scores in any key signature without having to remember to flatten or sharpen all the multiple notes required by the key signature.

5 Claims, 6 Drawing Sheets

FIG. 15
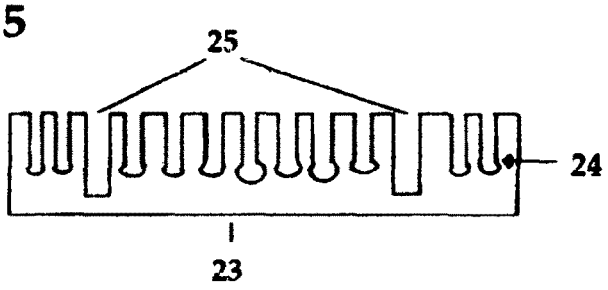
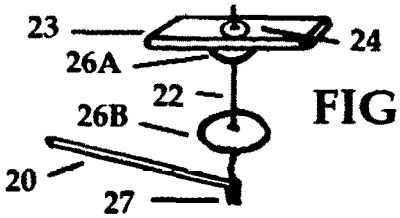
FIG. 16
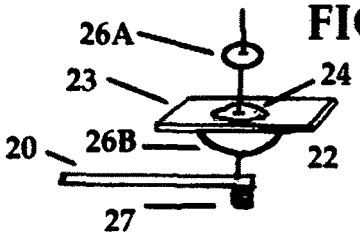
FIG. 17
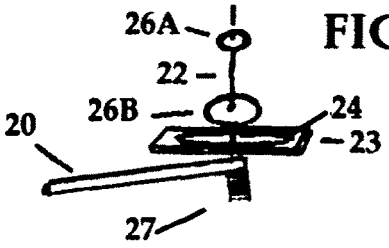
FIG. 18
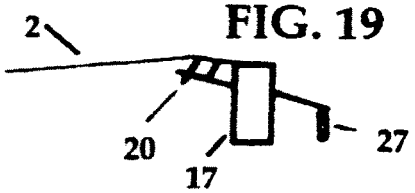
FIG. 19
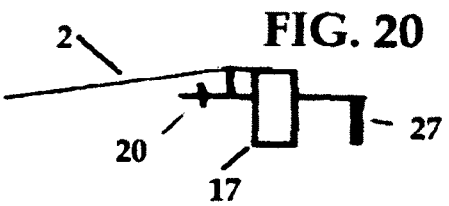
FIG. 20
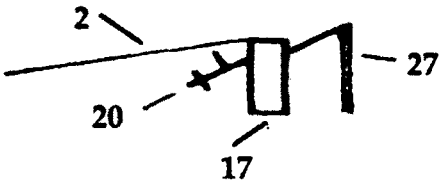
FIG. 21

MUSICAL KEY-CHANGING APPARATUS FOR STRINGED INSTRUMENTS

CROSS-REFERENCE TO RELATED APPLICATIONS

This application claims the benefit of priority to U.S. Provisional Application No. 62/178,728 filed on Apr. 20, 2015, which application is incorporated herein by reference in its entirety for all purposes. The Provisional Application implied certain Claims but did not explicitly state them. The Claims for the invention are stated in the current Utility Patent Application.

TECHNICAL FIELD

The present invention relates generally to stringed musical instruments such as zithers.

BACKGROUND

My invention was created with the intent of simplifying a stringed instrument so that all the strings are simultaneously set to the proper flats, sharps and naturals for any desired key signature.

My invention resulted from my looking for and being unable to find a musical instrument that met the personal criteria of being portable, non-electric, inexpensive, versatile and easy to play. Without enumerating specific instruments, problems generally were found in areas such as learning breath control for wind instruments and fingering patterns for stringed instruments, as well as problems in the area of limitations in key signatures in which many simple instruments can be played.

A piano is generally considered as an instrument friendly to beginners, but it helps to look at one drawback of the piano, and of most other musical instruments, this being that the player must remember the key signature of a song and remember to sharpen (meaning raise the pitch of) or flatten (meaning lower the pitch of) various notes when playing. For example, if the player looks at the written music and sees symbols for three flat notes at the beginning of the score, then the player must remember to flatten those three notes each time they appear in the music. My invention allows the player, with one adjustment, to flatten or sharpen all the necessary strings for any key signature, freeing the player from remembering to have to do so each time the relevant notes occur.

BRIEF SUMMARY OF MY INVENTION

My invention, a key-changing apparatus, would be most readily used on a type of zither commonly known as a melody lap harp. For purposes of playing music, there are 15 key signatures, with some of these having more than one name and with some of these being much less commonly used than others. The current invention allows easy selection of any of these 15 key signatures.

A simpler version of this invention could be used to select from a more limited range of key signatures, such as the 10 most commonly found key signatures. For description purposes, my invention is shown as being used on a a zither having 11 strings, but my invention could be used on zithers with fewer or more strings and could be used on stringed instruments other than zithers.

Another advantage of my invention is that a greater range of pitch can be produced by fewer strings since each string can produce the string's natural pitch or a sharp pitch or a flat pitch. To introduce an example, the treble clef, in which melodies generally are written, has five lines and four spaces, with a short line for the note of middle C below the clef and a space for D above this C. So this clef as commonly used has 11 natural notes, plus sharps and flats, which together are played by 19 keys on a piano keyboard. My invention, to cover this same range of notes in the treble clef, would require the player to keep track of only 11 strings rather than 19.

Although this key-changing apparatus saves the trouble of having to keep track of flats and sharps in the various key signatures, there is one additional concern about sharps, flats or naturals. This is when these occur as single note departures from the key signature in what is known as "accidental" notes. These require the player to take an action to modify the played note to conform to its accidental value. My apparatus as will be described has a procedure for playing accidentals notes.

The features of my invention differ from the features of an autoharp in that an autoharp dampens unwanted strings to allow the remaining open strings to be strummed to produce a desired chord. A very skilled autoharp player can play melodies and not just chords, but this requires a knowledge of what the various dampening buttons actually do in order to match desired strings and their settings with desired notes. This would not be an easy or intuitive process for the novice. With my invention, every string is always available for playing.

The features of my invention differ from the features of a levered harp in that a levered harp requires the player to set each string lever individually as to whether it is natural or not. My invention sets all the strings at once. When a key signature is changed on a levered harp, the player must be sure to remove any unwanted previously set levers. My invention automatically removes all previous sharps or flats when in the process of setting a new key signature.

The features of my invention differ from the features of a pedal harp in that while a pedal harp does set multiple strings as a class, for example, sharpening all C notes, it does require multiple pedals to set any multiple sharps in a key signature. My invention sets all the sharps or flats in a key signature with a single setting of one device.

My invention differs from a guitar capo in that while a capo does change the pitch of multiple strings at one time, a capo does not maintain what the inventor calls the home identity of strings. The inventor defines "home identity" to mean that any particular string is identified with a given line or space on the musical clef. With a capo, a guitar string that is tuned to G will no longer be a G if the capo is moved past the first fret. With the capo at the second fret, the guitar string will sound the note A instead of G, at the third fret an A sharp, at the fourth fret a B, and so on. An advantage of my invention is that a string designated as G will always be a G, being modified only as to being sometimes a sharp or a flat as demanded by a key signature. So for example, in a typical embodiment of my invention, the seventh note down from the top of the written treble clef, a G, would always be played on the instrument on the seventh from shortest string, a G, with this string so labeled as G.

Internet searches did not reveal any instruments similar to my invention. Some oriental zither-type instruments do have movable bridges for individual strings, but none of these has an apparatus to change all the pitches at once into a desired key signature.

A search of patents did not reveal any similar instrument to my invention. A possibly related patent known as a Sliding mechanism for chorded zither (publication number U.S. Pat. No. 8,188,352 BZ, publication date May 29, 2012, inventor William]. Bryant) was considered, but this patented invention differs from my invention in that the aforementioned Sliding mechanism deals with the ease of selecting chords, but does not tune all the strings of the instrument into specific key signatures. Another possibly related patent is a Hand-manipulated sharping lever for a harp (publication number U.S. Pat. No. 5,796,020, publication date Aug. 18, 1998, and inventor Betty R. Truitt) but the features of this patent do not include the ability to set multiple strings with a single setting.

My key-changing apparatus was conceived of as a way to allow an untrained musician to easily play any desired melody on a stringed instrument. As such, it might be most helpful to beginning musicians, music teachers, children, senior citizens, mentally challenged individuals, and others who wish to play melodies for their own personal enjoyment without pursuing music lessons. A musical instrument with a key-changing apparatus might be useful also to singers who would like to play their own simple musical accompaniment. Because of the simplicity of the key-changing feature, a user typically might play with the thumb and/or finger of one hand, which could make it a useful instrument in some forms of therapy. My invention was conceived originally with the intent of allowing easy playing of melodies, but a person with sufficient musical knowledge would be able to play chords and would be able to pursue more varied and complex fingering techniques. In the drawings, my invention is shown for use in the treble clef, where melodies or soprano lines occurs. Chording is often done in the bass clef, so a similar version of this invention could be produced for chording or bass playing there.

When once seen, the key-changing apparatus might seem obvious since, being elegant in design, it appears simple. However, if it were obvious, then someone surely would have seen and produced this by now considering the number of centuries in which stringed instruments have been designed, built and refined. Luthiers have not seen the need for a simple stringed instrument that the novice player can easily play without having to learn key signatures and fingering patterns. The current invention was conceived of to meet this need.

The inspiration for the actual design of a key-changing apparatus came from observation of the mathematical relationship between different note pitches. It was seen then that an apparatus could be designed on the basis of reflecting these mathematical relationships in a mechanical form.

One embodiment of the invention shown in the patent application shows the invention in use on a zither. Since the invention is not limited in use just to zithers, the invention is not seen as a zither improvement. The apparatus could be used in other stringed instruments, particularly simple harps. The apparatus could be used even with a pedal harp, with the invention placed in the area of the soundboard, and the pedals themselves then could be used exclusively to play accidental notes. Lutes could be built using this apparatus, and even guitars, although such guitars would have much different fingering patterns than guitarists are accustomed to now.

The first embodiment shown in the drawings has advantages of simplicity of design and low cost of manufacture. The embodiment as shown in the drawings produces sharps and flats that are somewhat approximate, yet within an acceptable range, particularly for solo amateur playing. As illustrated later, straight metal rods are being used in this first embodiment for fretting to produce sharps and flats. More exact precision in sharps and flats could be produced by a fret crafted with minor variations for individual strings rather than the simple rods seen in the first embodiment, but these crafted frets, as seen in prototypes that have been built, increase labor and material costs, thence hurting a goal of producing an inexpensive instrument for wide use.

The first embodiment of my invention as shown in the drawings uses three basic parts to control the pitch of strings, these parts being a spindle, a flat fret and a sharp fret. A second embodiment also will be described and illustrated, this embodiment relying on levers rather than a spindle as the means for setting sharp, flat, and natural notes.

Once the underlying concept of a key-changing apparatus is seen, it may be apparent that there are many possible alternative mechanisms that could achieve the same result. Mechanisms could use parts including but not limited to various types of cams, levers, rods, springs, push buttons, hooks, cords, pulleys, and/or plates. One such alternative embodiment is included in the claims, in the drawings and in the detailed description of my invention. Given the likelihood of others trying to find a way to work around this invention patent, acceptance of broad patent claims is requested to give the inventor protection for the initial overall conception of the need for simplifying stringed instruments and the conception of how to do so.

Figure 1:
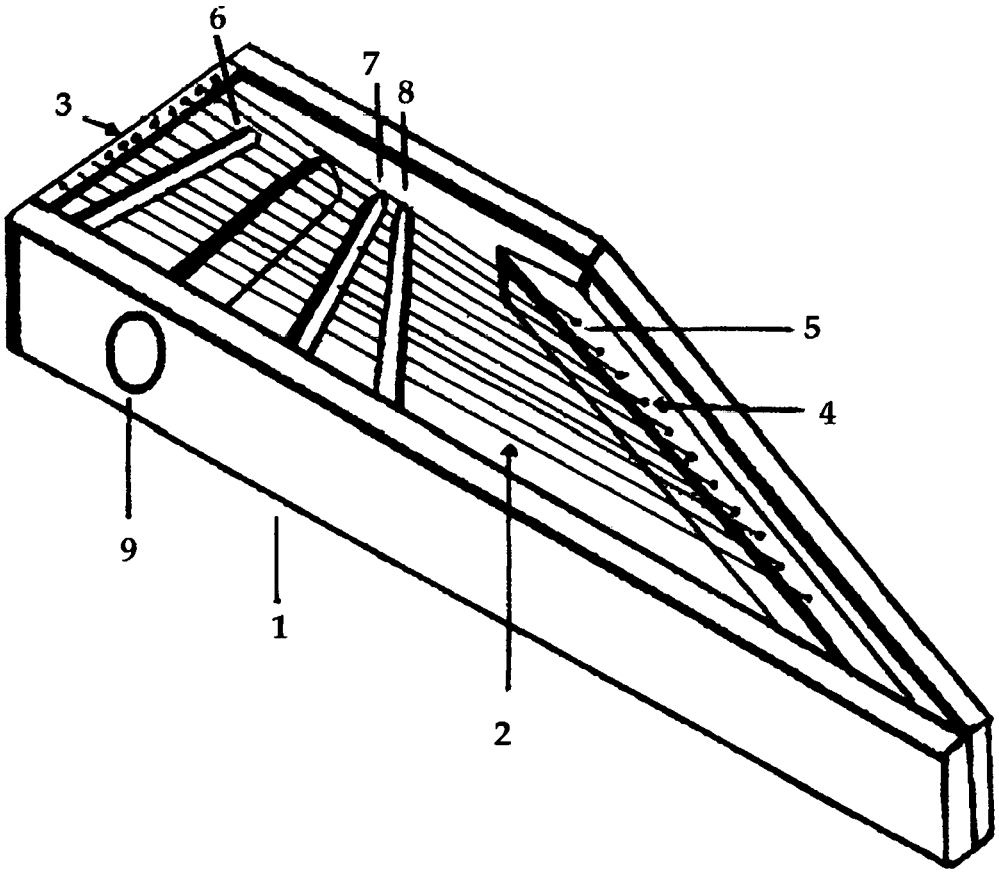
FIG. 1 gives an overview of the most essential parts of the first embodiment of the key-changing apparatus, shown here as being housed in a zither case.

The proportions in the drawings in FIG. 2 through FIG. 7, FIG. 12, and FIG. 16 through FIG. 21 are distorted in order to more clearly illustrate how the various parts relate to one another.

Figure 2:
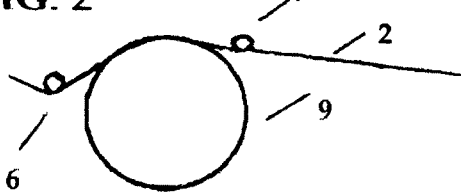

FIG. 2 shows how the string, spindle and frets relate to each other when a string is in a sharp-note position. This view shows a cross section of the spindle perpendicular to the strings.

Figure 3:
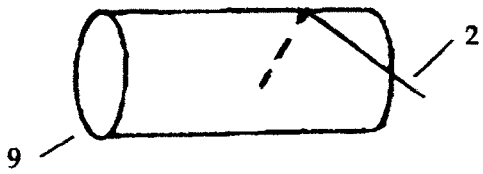

FIG. 3 is basically a 90-degree rotation of FIG. 2, but showing just the string and spindle.

Figure 4:
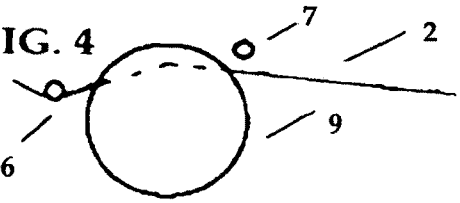

FIG. 4 shows how the string, spindle and frets relate to each other when a string is in a natural-note position. This view shows a cross section of the spindle perpendicular to the strings.

Figure 5:
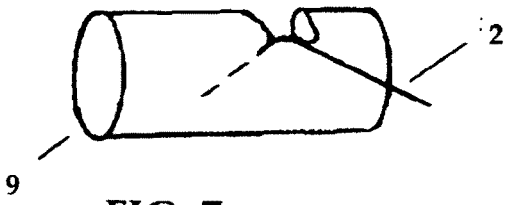

FIG. 5 is basically a 90-degree rotation of FIG. 4, but showing just the string and spindle.

Figure 6:
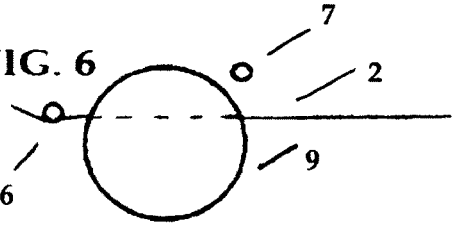

FIG. 6 shows how the string, spindle and frets relate to each other when a string is in a flat-note position. This view shows a cross section of the spindle perpendicular to the strings.

Figure 7:
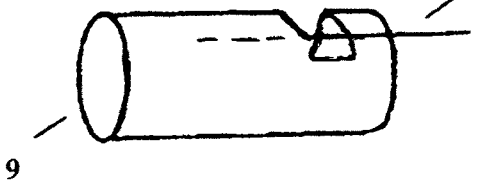

FIG. 7 is basically a 90-degree rotation of FIG. 6, but showing just the string and spindle.

Figure 8:
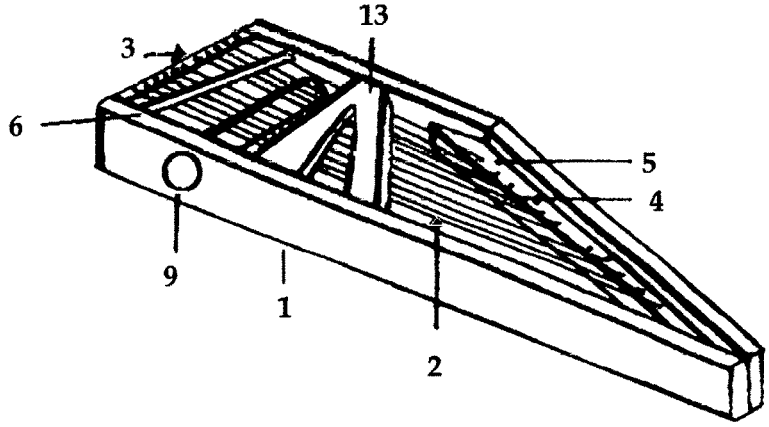

FIG. 8 shows the visual guide plate for where accidental notes are fretted.

Figure 9:
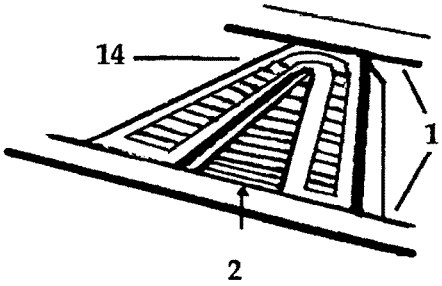

FIG. 9 illustrates the visual guide plate in a closer view, with labels showing where accidental flat, accidental sharp and accidental natural notes should be manually fretted.

Figure 10:
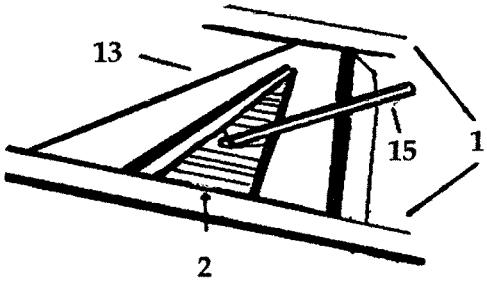

FIG. 10 is basically the same as FIG. 9, with the manual fretting device shown fretting a string.

Figure 11:
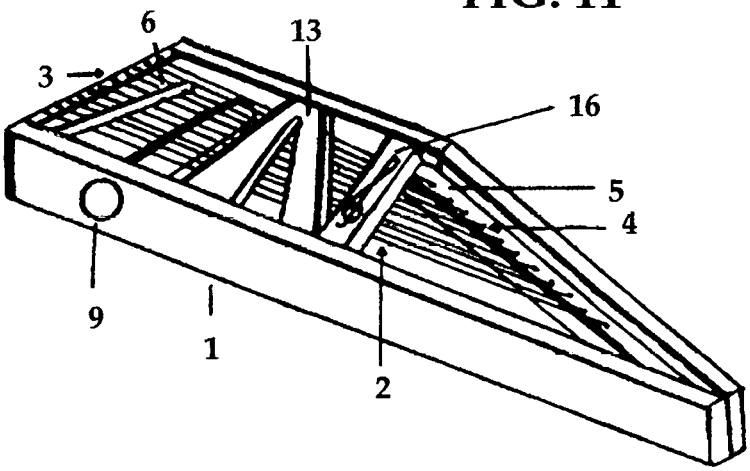

FIG. 11 shows the treble clef image in place on a plate above the strings.

Figure 12:
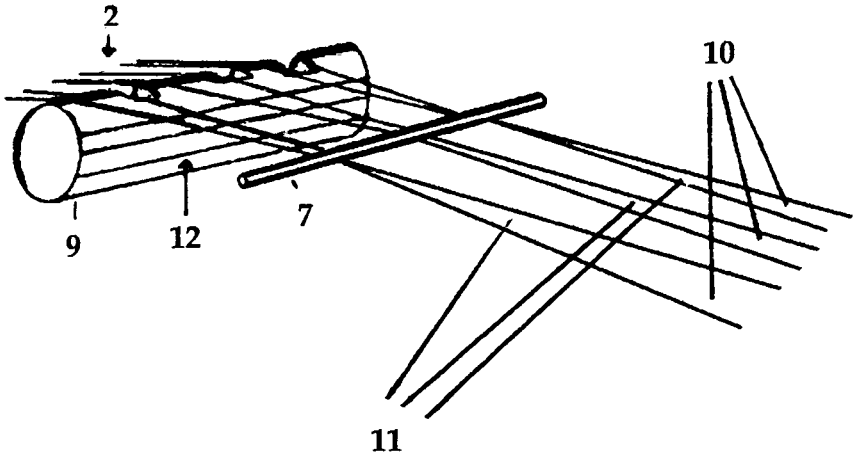

FIG. 12 shows the spindle with a plurality of key signature positions designated and with the spindle in position for sharpened fretting of one plurality of strings and natural fretting of another plurality of strings.

Figure 13:
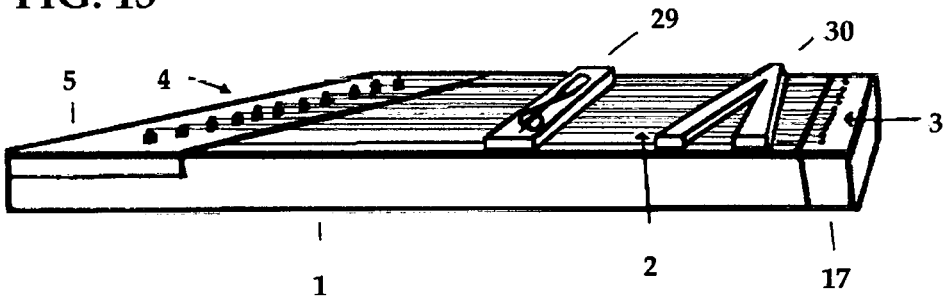

FIG. 13 shows an overview of representative stringed instrument, with a mounting block for the second embodiment of my key-changing apparatus, but with the apparatus itself not shown. This view does show the visual guide for fretting points for this instrument, and a treble clef image plate that shows the user which strings correspond to which notes on the treble clef.

Figure 14:
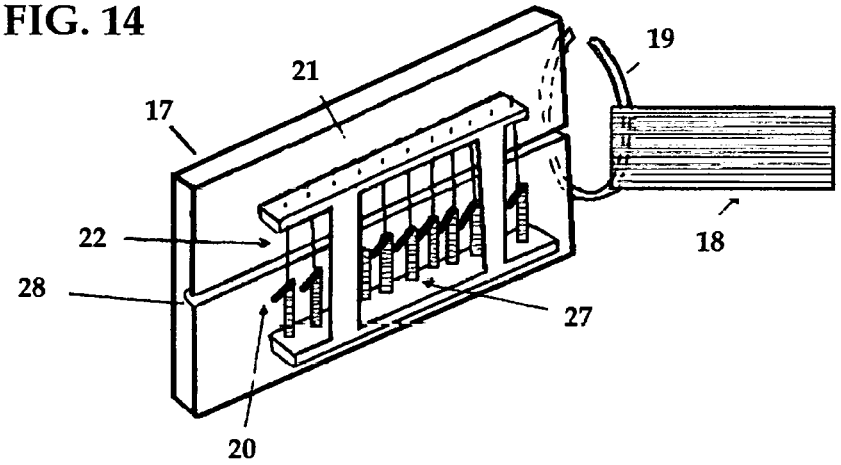

FIG. 14 shows the basic external structure of the key-changing apparatus attached to the mounting block, with the mounting block shown on the zither case in FIG. 13.

FIG. 15 shows a key-signature plate, with three different size holes.

FIG. 16 shows one of the three possible inter-relationships between a key-signature plate hole, the related connecting rod with its stops, and the related lever. This view illustrates the relationships of the parts for when a sharpened note is desired.

FIG. 17 shows the inter-relationships between a key-signature plate hole, the related connecting rod with its stops, and the related lever for when a natural note is desired.

FIG. 18 shows the inter-relationships between a key-signature plate hole, the related connecting rod with its stops, and the related lever for when a flattened note is desired.

FIG. 19 shows one of the plurality of levers, with its related string, in one of three possible positions, this position being for a sharpened notes as a result of the lever being in its bottom position outside the case and therefore in its top position inside the case.

FIG. 20 shows one of the plurality of levers, with its related string, in one of three possible positions, this position being for a natural note as a result of the lever being in its middle position outside the case and therefore in its middle position inside the case.

FIG. 21 shows one of the plurality of levers, with its related string, in one of three possible positions, this position being for a flattened note as a result of the lever being in its top position outside the case and therefore in its bottom position inside the case.

DETAILED DESCRIPTION OF MY INVENTION

In the first embodiment of the invention as shown in overview in FIG. 1, a spindle 9, which moves on its axis, is the effective means for regulating naturals, sharps and flats. It contains 15 positions, each running lengthwise on the spindle, for the 15 key signatures that it sets, with position labels 12 (shown later in FIG. 12) for each key signature. FIG. 12 also shows (in exaggerated angles) how the sculpted surface of the spindle 9, sets one plurality of strings to a sharpened position 10 and the remaining plurality of strings to a natural position 11. An individual can easily set a desired key signature by looking at the score to be played, counting the number of sharps or flats at the beginning of the score, and then turning the spindle to a position corresponding with the observed number of sharps or flats. If there are no sharps or flats, then the spindle would be set to a position for zero sharps and flats. There are no key signatures that contain both sharps and flats, so this would not be a consideration in key signature selection. The spindle also can be labeled in such a way that a key signature can be selected also by name, such as E flat.

Each key signature position of the spindle individually sets each of the plurality of the strings 2 as to their relative contact with the sharp fret 6, flat fret 7, and with the spindle 9 itself. The operation is somewhat like a ram. For each string in each note, the spindle surface can have one of three effective heights, as illustrated in FIG. 2 through FIG. 7. At the greatest height, the spindle surface 9 raises the string 2 upward from its baseline plane up to a height where the string contacts the sharp fret 6, reducing the string's vibrating length at this point so that a sharp note is produced. When the key signature calls for a certain note to remain natural, the spindle surface 9 is at a middle height so that it raises the string 2 height and stops the string's vibrating length at the spindle 9, which becomes in effect a natural fret. In this position, the string is not raised enough to contact the sharp fret. When a flat is needed, the spindle surface 9 is at its lowest height so that the spindle does not touch the string at all, meaning that the string vibrates its full distance to the flat fret 7, producing the flat note.

The apparatus is shown in FIG. 1 in a zither case 1, although the zither is not part of my invention. The zither is shown with standard zither parts: a plurality of strings 2, a plurality of string anchor pins 3, a plurality of string tuning pins 4, and a tuning-pin block 5. The invented apparatus itself is designed for use as a part of a stringed instrument, with the zither as an illustration.

Although the apparatus sets all the natural, sharp and flat notes for any given key signature, there is still the need for a way to play the occasional note that departs from the key signature, this type of note being called an accidental. The manual fretting points for each of these accidental notes are indicated on the apparatus by a frettting visual guide plate 13 (FIG. 8) attached to the instrument case, with the plate being parallel to and above the strings. The plate has a position label for each accidental sharp, each accidental flat, and each accidental natural, with an opening beside the labeling to allow the player access to the strings to do the manual fretting. This guide plate (with labels 14) is shown in a closer view in FIG. 9 and is shown with a manual fretting device 15 fretting a string in FIG. 10 with a zither tuning-peg wrench being of a convenient size for this. The sharp fret 7 and the natural fret 8 (shown in FIG. 1) serve as added physical guides as to where manual fretting should occur. As a player aid, there is a treble clef image plate 16 (FIG. 11) showing where each string relates to the treble clef. Thus a player can look at a score and know immediately the string where each note should be played.

Great variety is possible in the construction of musical instruments with which my key-changing apparatus could be used. However any musical instrument using this apparatus as described would need to have a string structure compatible with the apparatus. This means basically that any given string needs to be of a correct length from its tuning pin to the spindle contact point to allow production of the desired natural note and that the string then also needs to have enough length to extend back to the bass fret and an attachment point. The variables in determining string length for any given note are string material, string diameter and string tensioning, and the relationship of these variables. There are readily available formulas for the relationship of these variables.

As one example of prototype construction of a zither on which the key-changing apparatus could be used, the inventor used 0.014 inch diameter steel string in lengths ranging from about one foot to almost two feet for the various individual strings, with the overall instrument being about two feet long and about six inches or more in width. By using the same diameter of string for all the notes, the consistent mathematical proportions among note frequencies can be reflected in consistent mathematical proportions in instrument construction, for example in simplified construction and placement of sharp and flat frets.

One-half inch poplar wood has been used for case material. This embodiment of the instrument produces bell-like tones that do not depend on a soundboard or on any case interior dynamics. One-quarter inch steel rods were used for sharp and flat frets. Used for the spindle in the most recent prototype was a material known by various names including UHMW, which stands for Ultra High Molecular Weight, an industrial plastic used sometimes as a replacement for steel. It has excellent abrasion resistance, but is a very tough material, difficult to hand tool. Standard zither pins were used in prototype construction, both for the anchor pins and the tuning pins.

A clearance between the flat and natural positions of the strings of ⅛ inch was used in construction of this embodiment, and a clearance of ⅛ inch also was used between the natural position and sharp position of the strings. Given these dimensions, the spindle diameter in this particular construction should be at least 2.75 inches in diameter to allow sufficient circumference for 15 key signatures in a way that the sculpting of the spindle surface height for any given string in one key-signature setting does not extend into the sculpting of the surface for the string in the adjacent key-signature setting.

The manner of playing a musical instrument that uses my key-changing apparatus is the normal manner of play for the stringed instrument except that the player does not need to worry about key signature, sharps, and flats, other than for the occasional accidental note.

The second embodiment of my invention also is shown in relationship to a representative stringed instrument, a zither 1 in FIG. 13. This view shows standard zither parts: a plurality of strings 2, a plurality of string anchor pins 3, a plurality of string tuning pins 4, and a tuning-pin block 5. This view also shows a mounting block 17 for a lever based key-changing apparatus but does not show the apparatus itself. In this second embodiment, key selection is made by picking from a plurality of key-signature plates 18 (FIG. 14) that are stored on a ring 19 outside the case. As shown in FIG. 14, the external parts of the key-changing apparatus are attached to the mounting block 17 outside the case 1. Each of the key-signature plates 18 corresponds to a key signature, with the plates having vertical connecting rods 22 to levers 20 that in turn enter the zither case 1 and serve to fret the strings 2 to their desired flat, sharp and natural notes for the desired key signature. The internal parts are shown in FIG. 19, FIG. 20, and FIG. 21, which will be discussed later. Each single key-signature plate 21, as shown in FIG. 15, has a plurality of holes 24, with each hole corresponding to a musical note and its related string on the musical instrument, and with each hole being of three possible diameters. The key-signature plate 23 holes 24 are slotted to allow the key-signature plates to clear the connecting rods 24, with larger slots 25 to allow the plates to clear the connecting-rod support structure 21. Each hole 24 has a corresponding rod 22 running through it to its related lever 20. There are two stops on each connecting rod 22, a smaller stop 26A near the top of the rod and a larger stop 26B near the bottom of the rod. When a key-signature plate is pushed down into place into a locking slot 28, there are three possible relationships between the hole 24 in the plate 23, the relevant connecting rod 22 and the relevant lever 20. In the first relationship (FIG. 16) of the hole 24, rod 22, and lever 20, which occurs when a key signature calls for a sharpened note, the key-signature plate hole 24 is smaller in diameter than the top stop 26A on the rod 22, so that the rod 22 and its corresponding lever 20 both are pushed to a bottom position. In the second relationship (FIG. 17) of hole 24, rod 22, and lever 20, which occurs when a natural note is desired, the key-signature plate hole 24 is of a diameter so that it clears the smaller top stop 26A on the rod but pushes against the larger bottom stop 26B, pushing the rod 22 and its corresponding lever 20 both to a middle position. In the third relationship (FIG. 18) of hole 24, rod 22, and lever 20, which occurs when a flat note is desired, the hole 24 in the key-signature plate 23 is large enough in diameter that it clears both stops on the connecting rod 22, so the rod and and the corresponding lever 20 are not pushed down at all, so that the spring-loaded lever is left in its topmost setting. The levers 20 enter into the instrument case 1 parallel to and below the strings 20 in such a way that each lever 20 can move upward to contact a corresponding string. There are three lever positions possible inside the instrument case 1 corresponding to the three lever positions outside the instrument case 1. As shown in FIG. 19, when the lever 20 is not pushed down outside the case 1, the lever 20 is not raised inside the case 1 and the lever 20 then does not affect its related string 2, leaving it to vibrate its full length consistent with production of a flat note. As shown in FIG. 20, when the lever 20 is in its middle position outside the case 1, then the lever 20 is pushed up to a middle position inside the case 1 underneath its related string 2 with a projecting arm off of the lever 20 then contacting the string 2, fretting it at a predetermined length consistent with production of a natural note. As shown in FIG. 21, when the lever 20 is in its lowest position outside the case 1 then the lever 20 is pushed up inside the case 1 to its highest position so that a second projecting arm, which is shorter than the first arm and positioned on the lever 20 farther away from the instrument case than the first arm, then contacts the string 2 and raises the string higher than the first arm, fretting the string 2 at a predetermined shorter length consistent with production of a sharp note.

As shown in FIG. 13, this embodiment also has a guide plate to show the position for fretting of accidental notes 29 and, a treble clef image plate 30, which is a visual aid showing for each note on the treble clef which string should be played. The treble clef image should be of great help in quickly and easily learning to play music with this key-changing apparatus.

I claim:

1. A zither comprising:

a. a zither case b. a plurality of strings with each string of said plurality of strings having a first predetermined length corresponding to a plurality of flattened musical notes, with said plurality of strings attached to said zither c. a spindle apparatus to set one of a plurality of key signatures onto said plurality of strings while maintaining a home identity of each individual said string of said plurality of strings in each of said plurality of key signatures, with said spindle of said spindle apparatus attached to said zither case near to and transverse to said plurality of strings in a plane parallel to said plurality of strings with said spindle at a first calculated distance from one set of ends of said plurality of strings for a first calculated length of strings corresponding to natural musical notes and with said spindle having a plurality of rotatable key signature positions, with said spindle for each said string in each said key signature position having in a first instance a first predetermined radius to contact and fret each said string of said plurality of strings at said first calculated length corresponding to a natural note when said one of said plurality of key signatures requires said natural note for said string d. said spindle apparatus to further include a sharp fret transverse and near to said plurality of strings, with said plurality of strings sandwiched between said sharp fret and said spindle, and with said spindle for each said string in each said key signature position having in a second instance, when said one of said plurality of key signatures requires a sharp note for said string, a second predetermined radius to push said string against said sharp fret with said sharp fret at a second calculated distance from said one set of ends of said plurality of strings consistent with a second calculated length of said string corresponding to said sharp note in said second instance.

2. The zither of claim 1 to further include a visual guide plate to label manual fretting points for accidental notes and a treble clef image plate to label said home identity of each of said plurality of strings with each of said plates being near to, and in a third plane parallel to, said plurality of strings, and with each of said plates attached to said zither case.

3. A zither comprising:

a. a zither case b. a plurality of strings with lengths corresponding to a plurality of musical notes c. a plurality of string anchor pins to connect a first set of ends of said plurality of strings to said zither d. a plurality of tuning pins to connect a second set of ends of said plurality of strings to a tuning-pin block which is attached to said zither case e. a spindle means to change a key signature of said plurality of strings while maintaining a home identity of each string of said plurality of strings regardless of said key signature change.

4. The zither of claim 3 to further include:

a. a flat fret connected to said zither case at a position near to said plurality of string anchor pins, with said flat fret transverse to said plurality of strings, and in contact with said plurality of strings, and with each of said plurality of tuning pins further positioned at a calculated distance from said flat fret for a flattened-note length for each string of said plurality of strings b. a sharp fret connected to said zither case in a first plane parallel to said plurality of strings and in a transverse direction to said plurality of strings and near to said plurality of strings and with said plurality of strings between said sharp fret and said flat fret and with said sharp fret at a predetermined distance from said plurality of tuning pins for a sharpened-note length for each string of said plurality of strings c. said spindle means to change said key signature, with said spindle housed in said zither case, with said spindle's axis in a second plane parallel to said plurality of strings, and with direction of said spindle axis transverse to direction of said plurality of strings and with said plurality of strings between said spindle and said sharp fret and with said spindle having a plurality of rotatable key signature positions with each one of said plurality of rotatable key signature positions having a calculated spindle surface height, as measured from said axis of said spindle, at each crossing point of said spindle with each said individual string, with in a first instance said spindle having a first calculated spindle surface height where said spindle does not contact said individual string in said first instance which is applicable when said string corresponds to said flattened note in said selected key signature, and said spindle in a second instance having a second calculated spindle surface height where said spindle does contact said individual string to fret it to a length for a natural note in said second instance which is applicable when said individual string corresponds to said natural note in said selected key signature, and said spindle in a third instance having a third calculated spindle surface height where said spindle pushes said individual string into contact with said sharp fret in said third instance which is applicable when said individual string corresponds to said sharpened note in said selected key signature.

5. The zither of claim 4 to further include a visual guide plate as a means to label manual fretting points for accidental notes and a treble clef image plate as a means to identify said home identity of each of said plurality of strings, with each of said plates being near to, and in a third plane parallel to, said plurality of strings and with each of said plates connected to said zither case.

* * * * *